US011350766B2

(12) United States Patent
Olfers et al.

(10) Patent No.: US 11,350,766 B2
(45) Date of Patent: Jun. 7, 2022

(54) CARRY HANDLE FOR CHILD CARRIER

(71) Applicant: Dorel Juvenile Group, Inc., Foxboro, MA (US)

(72) Inventors: Dennis Olfers, AV Leende (NL); Robért Sjang Josine Van Dijk, Eindhoven (NL)

(73) Assignee: Dorel Juvenile Group, Inc., Foxboro (MA)

( * ) Notice: Subject to any disclaimer, the term of this patent is extended or adjusted under 35 U.S.C. 154(b) by 212 days.

(21) Appl. No.: 16/842,884

(22) Filed: Apr. 8, 2020

(65) Prior Publication Data

US 2020/0323360 A1 Oct. 15, 2020

(30) Foreign Application Priority Data

Apr. 9, 2019 (NL) ..... 2022903

(51) Int. Cl.
*A47D 13/02* (2006.01)

(52) U.S. Cl.
CPC ..... *A47D 13/02* (2013.01)

(58) Field of Classification Search
CPC .... A47D 13/02; A47D 13/002; A47D 13/005; A47D 13/025
USPC ..... 294/140
See application file for complete search history.

(56) References Cited

U.S. PATENT DOCUMENTS 2,554,340 A * 5/1951 Maxwell ..... A47D 13/025 294/140
3,096,917 A * 7/1963 Gudiksen ..... A47D 15/003 294/140
3,968,911 A * 7/1976 Haas ..... A47D 13/02 224/158
D253,557 S * 12/1979 Thompson ..... D3/213
5,265,932 A * 11/1993 Leonard ..... A47D 13/02 297/131
5,267,680 A * 12/1993 Torok ..... A47D 13/02 224/158
5,540,365 A * 7/1996 LaMair ..... A47D 13/02 224/158
6,179,383 B1 1/2001 Ochi
7,445,560 B2 11/2008 Greger
7,658,446 B2 2/2010 Meeker
7,740,313 B1 6/2010 Hei
7,810,682 B2 10/2010 Balensiefer
7,971,933 B2 7/2011 Tuckey
8,182,033 B2 5/2012 Hei
8,214,950 B2 7/2012 Topaz
8,393,505 B2 3/2013 Coote
(Continued)

FOREIGN PATENT DOCUMENTS

DE 102014103361 B3 7/2015
KR 20130085778 A 7/2013
WO 2012162757 A1 12/2012

OTHER PUBLICATIONS

Extended European Search Report for European Patent App. No. 20168754.8 dated Jun. 22, 2020, 5 pages.

*Primary Examiner* — Paul T Chin
(74) *Attorney, Agent, or Firm* — Barnes & Thornburg LLP

(57) ABSTRACT

A carrying device includes an object to be carried and an object carrier coupled to the object to be used in carrying the object. The object carrier includes a handle connected with at least one end to the object and movable between a retracted position to a carrying position. The object may be an infant seat.

20 Claims, 11 Drawing Sheets

(56) References Cited

U.S. PATENT DOCUMENTS

| | | | | |
|---|---|---|---|---|
| 8,550,548 | B2 | 10/2013 | Gibbons | |
| 8,684,454 | B2 | 4/2014 | Chipman | |
| 8,702,169 | B2 | 4/2014 | Abadilla | |
| 8,845,028 | B2 | 9/2014 | Miller | |
| 8,864,166 | B2 | 10/2014 | Longenecker | |
| 8,905,451 | B1 * | 12/2014 | Golz | A62B 3/00 294/140 |
| 8,960,794 | B2 * | 2/2015 | St. Pierre | A47D 13/02 297/256.16 |
| 9,066,609 | B2 | 6/2015 | Starr | |
| 9,271,580 | B2 | 3/2016 | Beekman | |
| 9,326,619 | B2 | 5/2016 | Krass | |
| 9,357,852 | B2 | 6/2016 | Salazar | |
| 9,510,694 | B2 | 12/2016 | Hozer | |
| 9,637,153 | B2 | 5/2017 | Sclare | |
| 9,681,758 | B2 | 6/2017 | Lau | |
| 9,687,083 | B1 | 6/2017 | Romero | |
| 9,743,778 | B2 | 8/2017 | Garritt | |
| 9,771,006 | B2 | 9/2017 | Forbes | |
| 9,918,561 | B2 | 3/2018 | Perrin | |
| 9,943,457 | B2 | 4/2018 | Starr | |
| 10,028,592 | B1 | 7/2018 | Ruiz | |
| 10,070,738 | B1 | 9/2018 | Royalty | |
| 11,134,793 | B2 * | 10/2021 | Smith | B62B 7/145 |
| 2007/0188002 | A1 * | 8/2007 | Jane Santamaria | B60N 2/2845 297/256.1 |
| 2007/0284403 | A1 * | 12/2007 | Minami | A47D 13/02 224/160 |
| 2014/0296045 | A1 | 10/2014 | Krstanoski-Blazeski | |
| 2018/0008057 | A1 | 1/2018 | Salinson | |
| 2018/0220808 | A1 | 8/2018 | Anderson | |
| 2019/0038044 | A1 | 2/2019 | Cummings | |
| 2019/0281995 | A1 | 9/2019 | Troutman | |

* cited by examiner

CARRY HANDLE FOR CHILD CARRIER

PRIORITY CLAIM

This application claims priority to Netherlands patent application NL2022903 filed Apr. 9, 2019, which application is hereby incorporated by reference herein.

BACKGROUND

The present disclosure relates to a carrying device and particularly to a carrying device comprising at least one object to be carried and at least one handle connected with at least one end to the object. More particularly, the present disclosure relates to a child restraint including an infant carrier and a handle for the infant carrier.

SUMMARY

According to the present disclosure, a child restraint includes a seating bucket adapted to carry a child and a bucket carrier coupled to the seating bucket. In illustrative embodiments, the bucket carrier includes first and second side carrying parts coupled to the seating bucket.

In illustrative elements, each of the first and second side carrying parts of the bucket carrier includes a movable strap and an elastic element. The movable strap is arranged to be gripped by a caregiver to allow the caregiver to carry the seating basket. The elastic element is coupled to the movable strap and to the seating bucket. The seating bucket is a shell-shaped seat in illustrative embodiments of the present disclosure.

In illustrative embodiments, the elastic element of each of the first and second side carrying parts of the bucket carrier is configured to yieldably and automatically pull the movable strap in an inward direction through a strap-receiving passage formed in the seating bucket from a temporary CARRYING position to a normal RETRACTED position when the movable strap is released by a caregiver that had been using the bucket carrier to carry the seating bucket. When a caregiver grips and pulls on the movable strap to lift the seating bucket upwardly, the movable strap is moved through the strap-receiving passage formed in the seating bucket in an outward direction to move from the normal RETRACTED position to a temporary CARRYING position.

In illustrative embodiments, the elastic element of each of the first and second side carrying parts of the bucket carrier remains hidden from the view of the caregiver in a covered space provided in the seating bucket whether the movable strap occupies the normal RETRACTED position when the seating bucket is at rest or the temporary CARRYING position when the seating bucket is being carried. This causes the caregiver to perceive that each carrying part comprises only a flexible-but-not-elastic strap since that is the only portion of each carrying part that is visible to the caregiver.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed disclosure particularly refers to the accompanying FIGS. in which.

DETAILED DESCRIPTION

Figure 1:
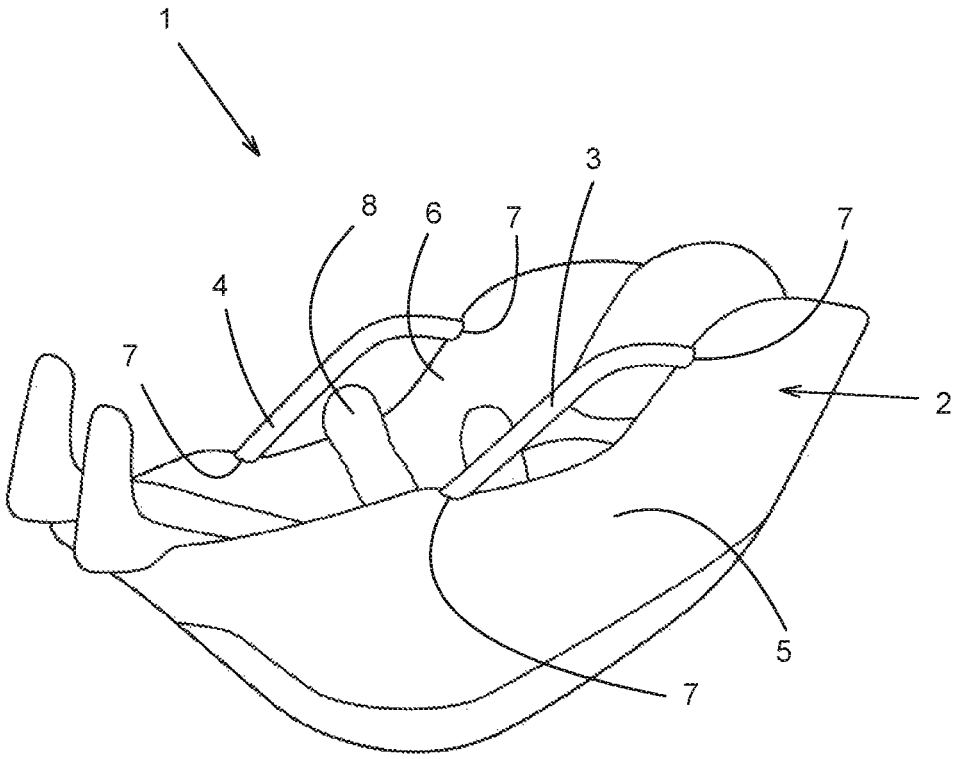
FIG. 1 is a perspective view of a child-carrying device according to the present disclosure, each carrying part of a handle included in the child-carrying device being shown in a normal RETRACTED position.
Figure 2:
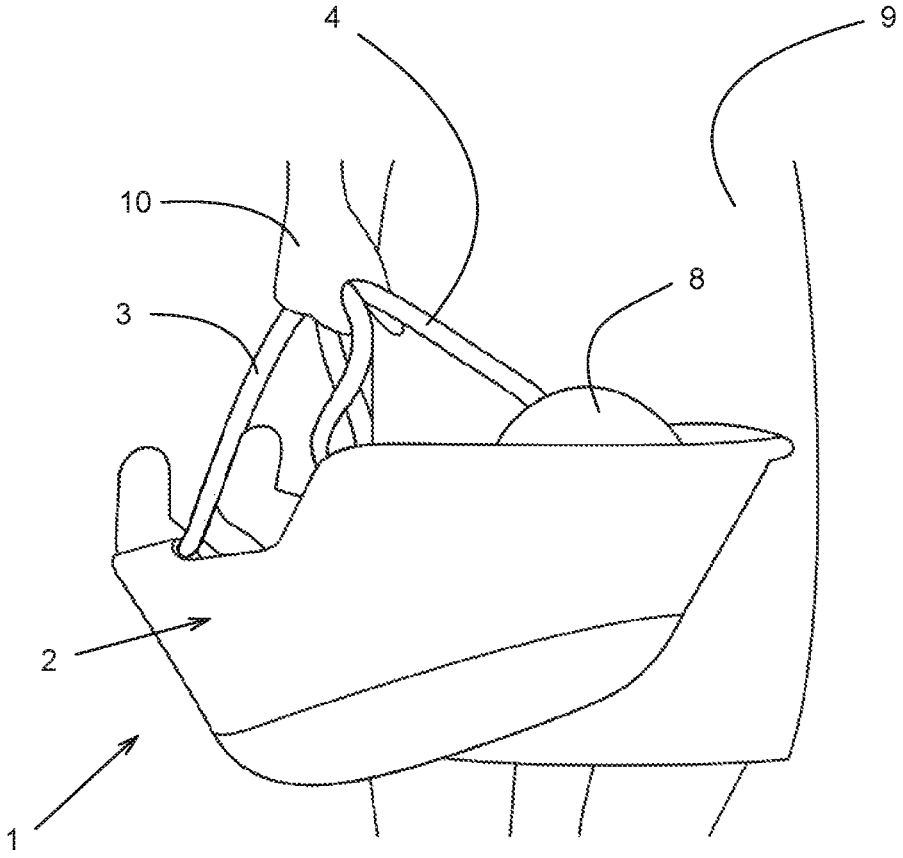
FIG. 2 is a perspective view of a child-carrying device as shown in FIG. 1, with the each carrying part of the handle being shown in a temporary CARRYING position.
Figure 3A:
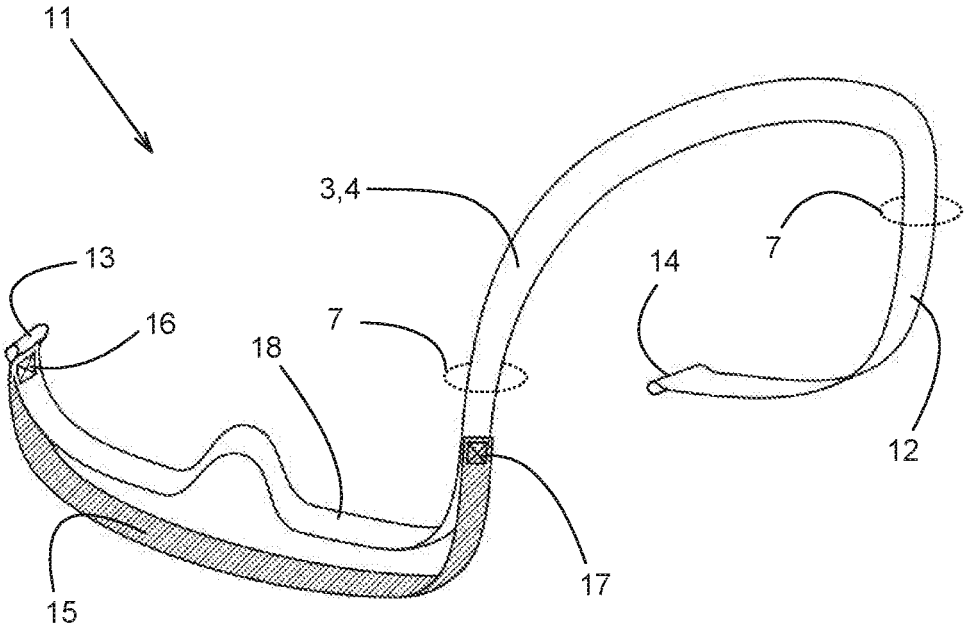
FIGS. 3A and 3B illustrate a first embodiment of a handle of a carrying device according to the present disclosure showing one of the carrying parts of the handle in a normal RETRACTED position and in a temporary CARRYING position, respectively.
Figure 3B:
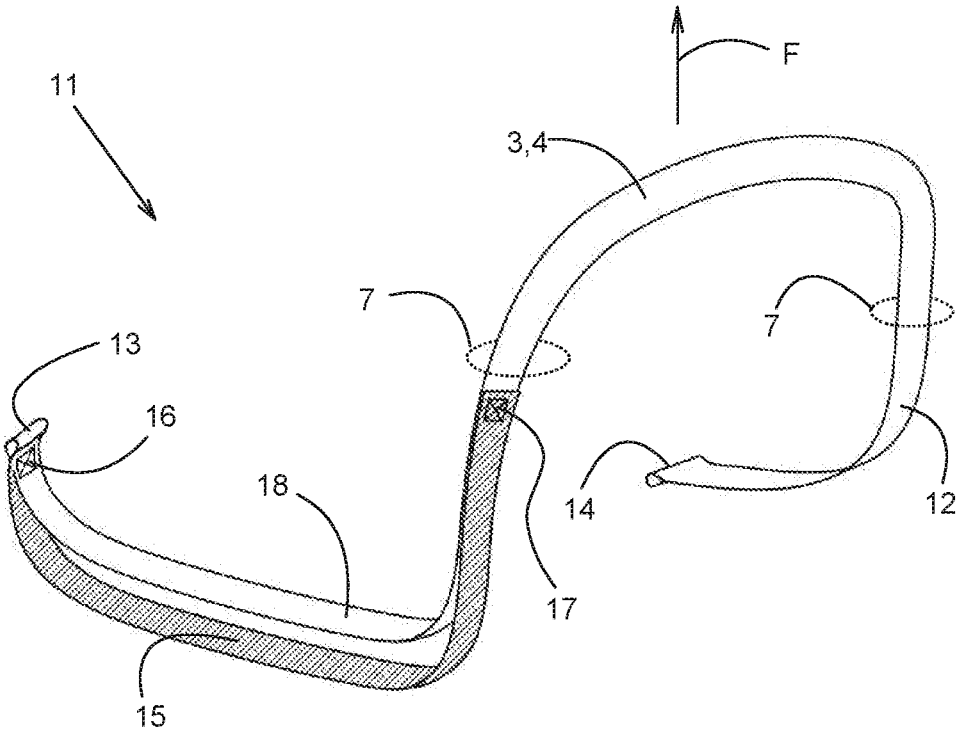
Figure 4A:
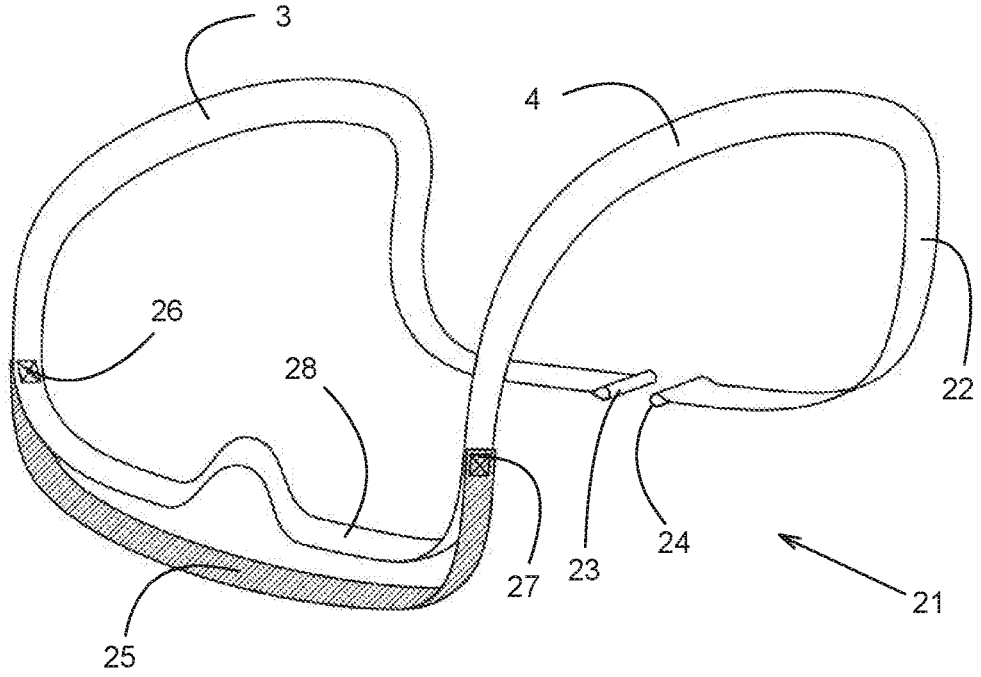
FIGS. 4A and 4B illustrate a second embodiment of a handle of a carrying device according to the present disclosure showing each of the carrying parts of the handle in a normal RETRACTED position and in a temporary CARRYING position, respectively.
Figure 4B:
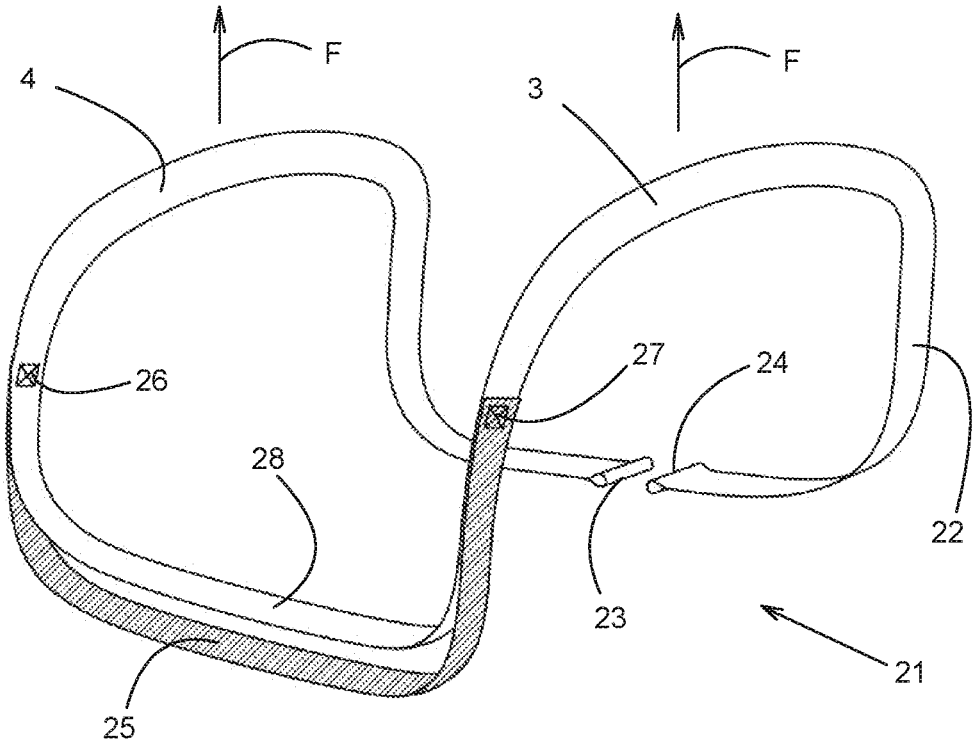
Figure 6A:
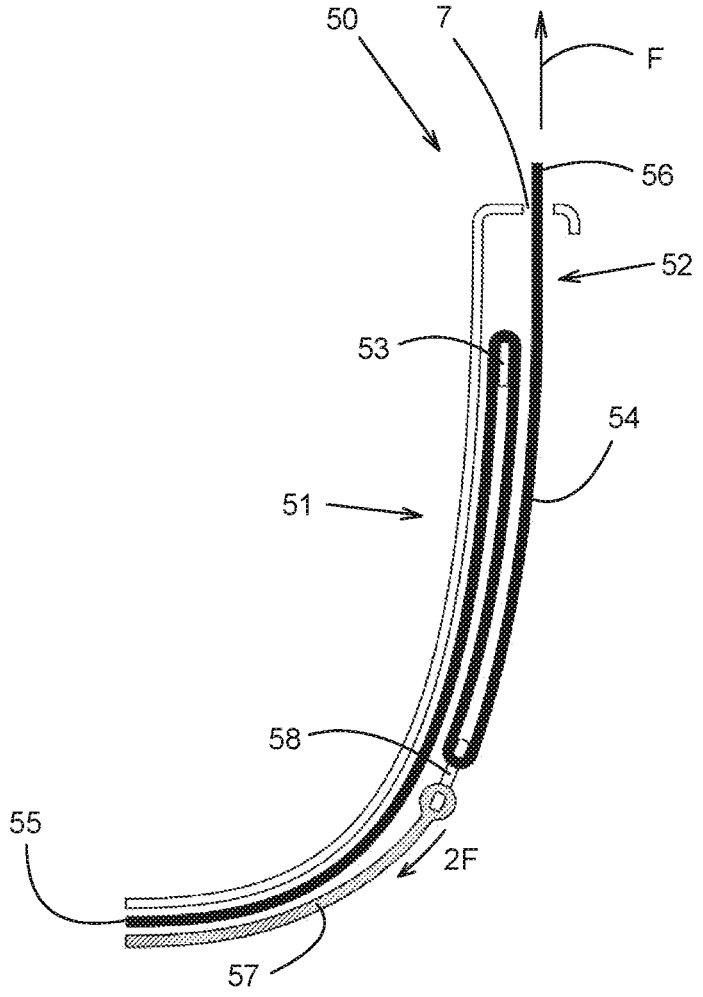
FIGS. 6A and 6B are detailed cross sections of a fourth embodiment of a child-carrying device according to the present disclosure in a normal RETRACTED position and in a temporary CARRYING position, respectively.
Figure 6B:
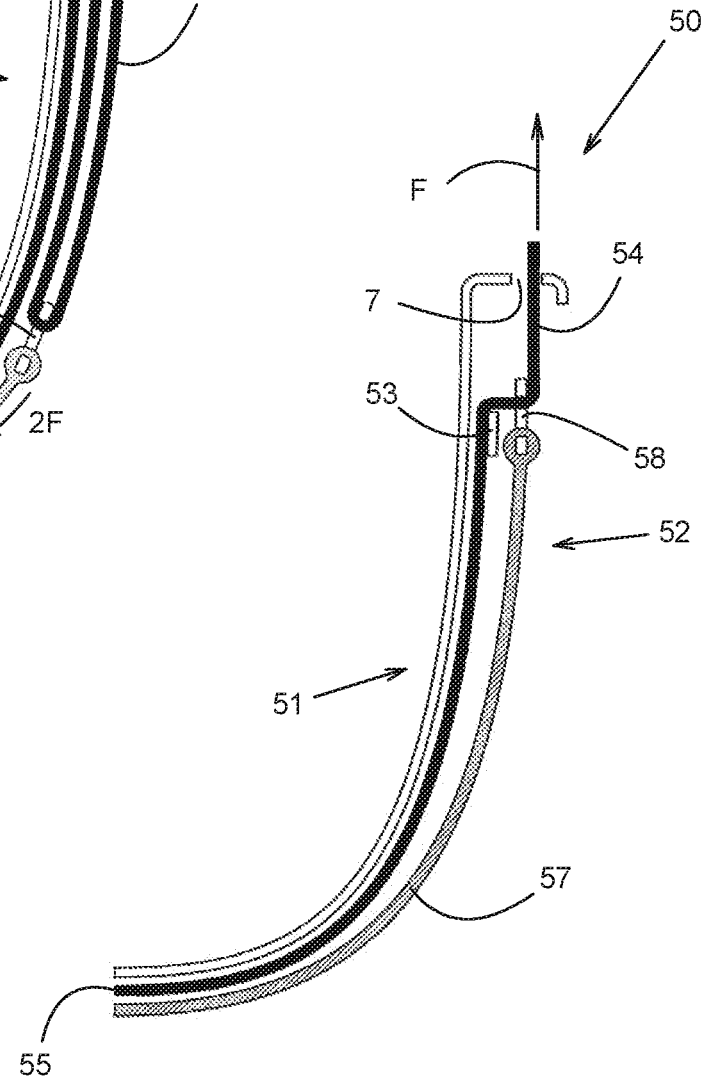
Figure 7A:
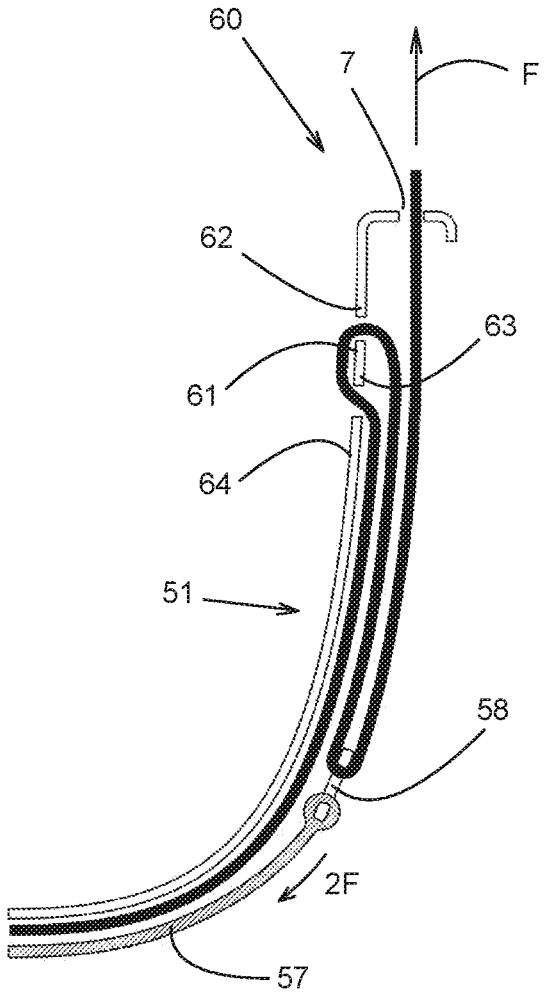
FIGS. 7A and 7B are detailed cross sections of a fifth embodiment of a child-carrying device according to the present disclosure in a normal RETRACTED position and in a temporary CARRYING position, respectively.
Figure 7B:
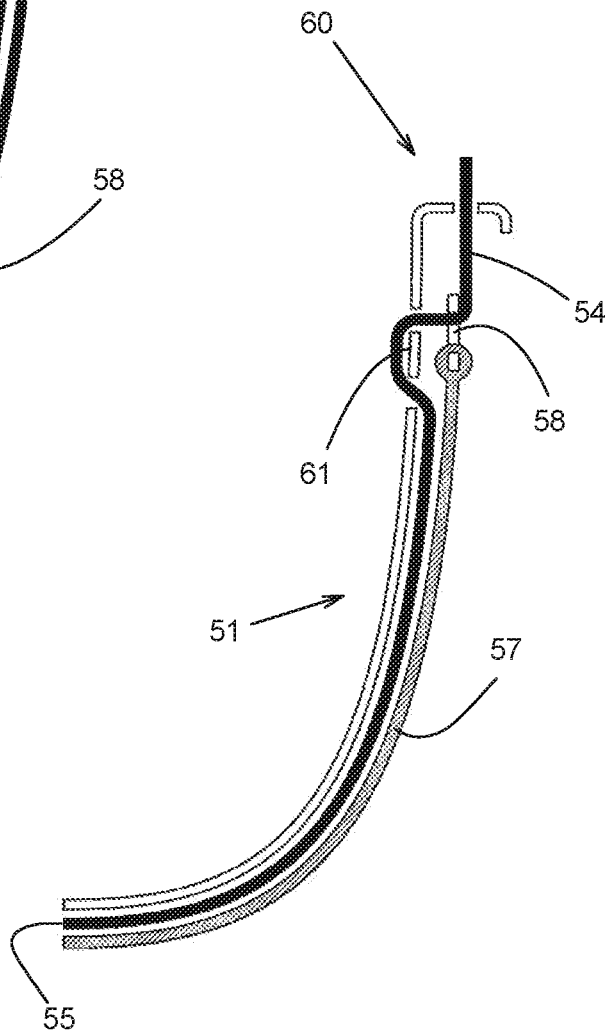
Figure 8:
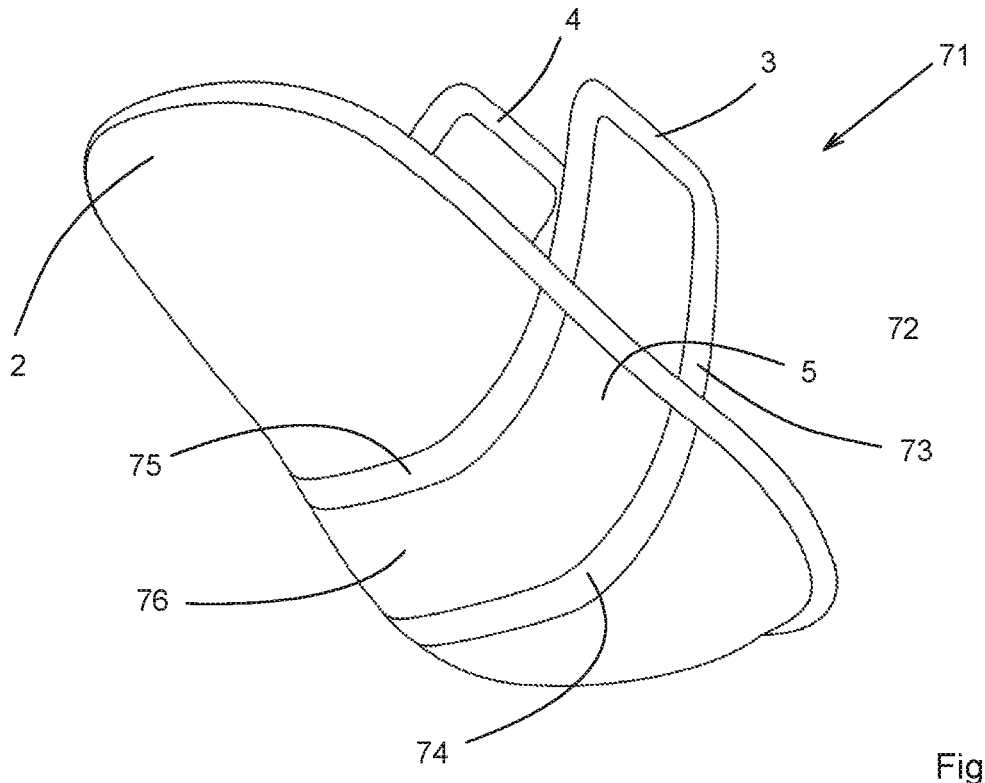
FIGS. 8, 9 and 10 show perspective views of a child-carrying device with different locations and orientations of the handle of the carrying device according to the present disclosure.
Figure 9:
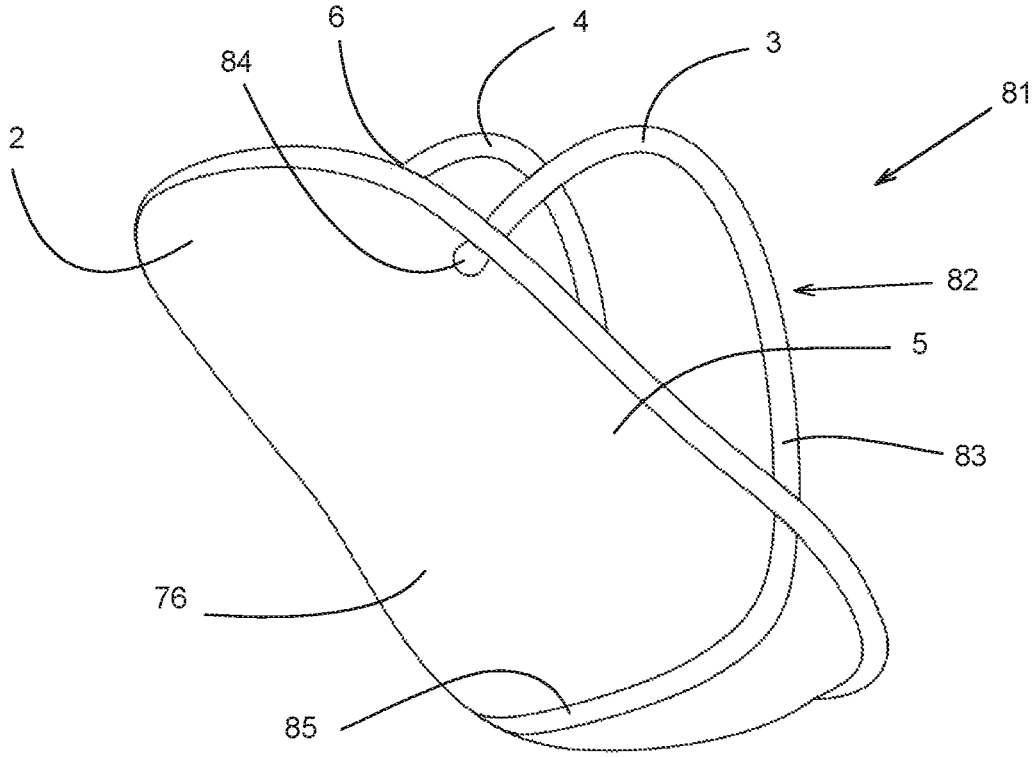
Figure 10:
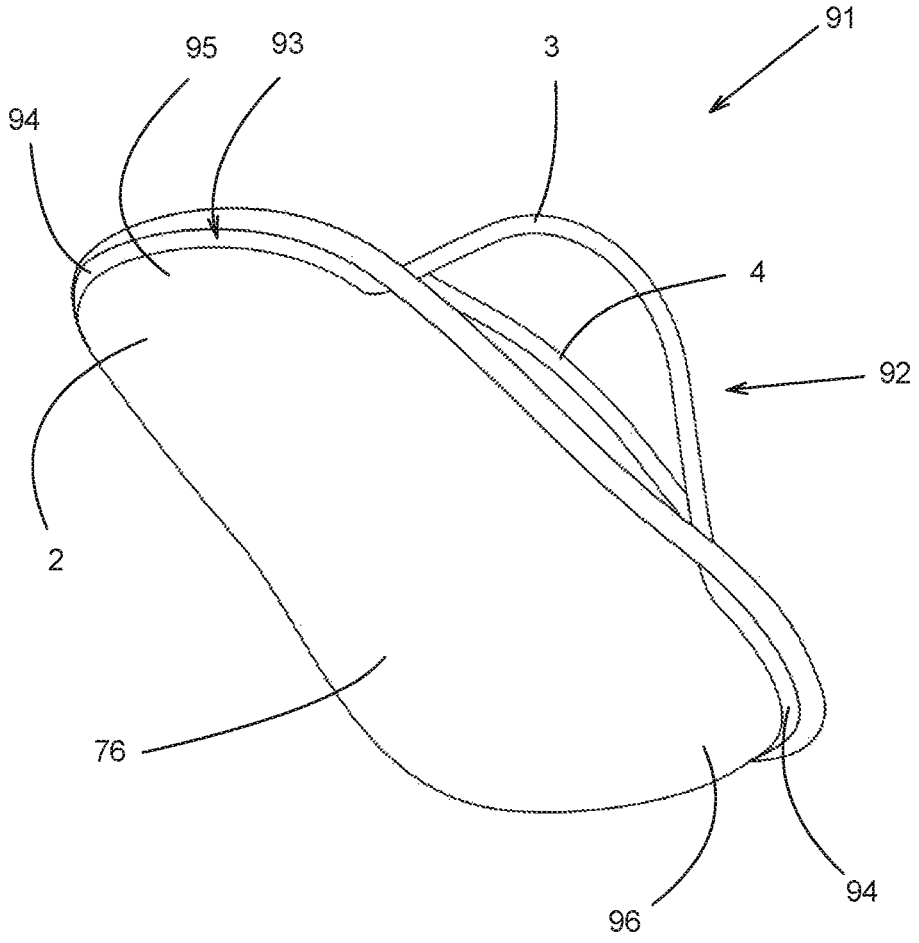

A general disclosure of a child-carrying device 1 in accordance with the present disclosure is provided in FIGS. 1 and 2. A first embodiment of a handle 11 in accordance with the present disclosure is illustrated in FIGS. 3A and 3B, while a handle 21 in accordance with a second embodiment of the present disclosure is illustrated in FIGS. 4A and 4B. Handle 31 in accordance with the Third embodiment of the present disclosure is shown in FIGS. 5A-5D, while a handle 52 in accordance with a fourth embodiment of the present disclosure is illustrated in FIGS. 6A and 6B and a handle in accordance with a fifth embodiment of the present disclosure is illustrated in FIGS. 7A and 7B. Features of the present disclosure including handles 72, 82, 92 are illustrated in FIGS. 8-10.

Perspective views of a child-carrying device 1 in accordance with the present disclosure are shown in FIGS. 1 and 2. Child-carrying device 1 comprises a shell-shaped seat 2 (i.e., seating bucket) and a handle including two carrying parts 3, 4 that are visible on both lateral sides 5, 6 of shell-shaped seat 2 and are shown in a normally RETRACTED position. The carrying parts 3, 4 extend through passages 7 formed in shell-shaped seat 2 as suggested also in FIG. 2 from the outside of shell-shaped seat 2 to the inside of shell-shaped seat 2, rendering the further part of the handle out of view.

Shell-shaped seat 2 can support a child 8 as suggested in FIG. 1. Shell-shaped seat 2, with or without a child 8, forms an OBJECT to be carried by a caregiver in accordance with the present disclosure.

As suggested in FIG. 1, a bottom of shell-shaped seat 2 rests on a support, like a floor, a seating part of a vehicle passenger seat, a base of a child safety seat, or a stroller. The handle and the carrying parts 3, 4 of the handle are in the normal RETRACTED position wherein no external force is exerted on the handle. The carrying parts 3, 4 are located on the lateral sides 5, 6 of the shell-shaped seat 2 and do not hinder the seated child 8. The carrying parts 3, 4 are part of at least one non-elastic strap as will be explained herein.

When a caregiver grips the carrying parts 3, 4 in the normal RETRACTED position shown in FIG. 1 and exerts a pulling force on the carrying parts 3, 4, additional parts of the non-elastic strap will move through the passages 7 formed in shell-shaped seat 2 to extend the part of the non-elastic strap located outside the shell-shaped seat 2 to the temporary CARRYING position shown, for example, in FIG. 2 so that a person 9 can hold both carrying parts 3, 4 of the handle with one hand 10 to lift the shell-shaped seat 2 with the child 8 located therein upwardly and to carry it around. The two carrying parts 3, 4 of the handle are positioned against or near each other in the temporary CARRYING position as shown in FIG. 2. When the person 9 places the shell-shaped seat 2 back on a support, the non-elastic strap will be moved automatically back to the normal RETRACTED position as suggested in FIG. 1.

A carrying device in accordance with the present disclosure includes a seating-bucket carry handle that can be moved easily from a normal RETRACTED position to a temporary CARRYING position, and vice versa. The seating-bucket carry handle is movable relative to the seating bucket 2 between a RETRACTED position and a CARRYING position. The retractable handle comprises a flexible, non-elastic strap adapted to be held by a caregiver and at least one elastic element that is coupled to the flexible, non-elastic strap and configured to bias the flexible, non-elastic strap toward the normal RETRACTED position.

If no pulling force is applied to the retractable handle by a caregiver, the elastic element will retract under influence of the spring force of the elastic element to an unloaded position. In accordance with the present disclosure, the elastic element can be an elastic band or other material like a spring having elastic characteristics which can be elongated against spring force and be returned to its unbiased length under spring force.

Due to the elastic element the flexible non-elastic strap will be folded or rippled between the at least one end of the non-elastic strap and the at least one end side of the elastic band. The amount of folding depends in accordance with the present disclosure on the difference in length of the elastic element in the normal RETRACTED position and in the temporary CARRYING position.

When the seating bucket 2 needs to be lifted, a caregiver takes the handle due to which the weight of the seating bucket 2 and an infant in the seating bucket 2 and applies a pulling force on the non-elastic strap. Due to this force, the non-elastic strap will be moved from its folded or rippled position into a tight position against the spring force of the elastic element whereby the elastic element will be extended.

As soon as the non-elastic strap can no longer be moved by the caregiver between the seating bucket 2 and the carrying part, the elastic element will no longer be extended and the maximum force on the elastic element is reached. No additional forces will be applied on the elastic element so that overstretching of the elastic element is easily prevented, rendering the lifespan of the elastic element relatively long. The forces of the seating bucket 2 and seated infant 8 on the handle will be fully carried by the non-elastic strap. This also provides the caregiver with a safety perception identical to the caregiver experience with non-elastic straps without such an elastic band. Both spaced-apart side end of the elastic element can be connected to the non-elastic strap. It is also possible in accordance with the present disclosure that the one side end is connected to the non-elastic strap while the other side end is connected to seating bucket 2, as long as in the CARRYING position the weight of seating bucket 2 and seated infant 8 is carried only by the non-elastic strap.

If the seating bucket 2 is placed on a support such as bucket-support base and a caregiver releases the handle, the handle will automatically move to the normal RETRACTED position shown in FIG. 1 under influence of the spring force of the stretched elastic band. In the normal RETRACTED position, the handle will have a fixed position so that the handle can always be found easily by a caregiver.

A FIRST embodiment of a handle 11 of a carrying device such as a child-carrying device 1 according to the present disclosure, is shown in a normal RETRACTED position in FIG. 3A and in a temporary CARRYING position in FIG. 3B. The child-carrying device 1 comprises two such handles 11, one handle 11 comprising the carrying part 3 and one handle II comprising the carrying part 4.

Handle 11 comprises an elongated FLEXIBLE-BUT-NON-ELASTIC strap 12 having a first end 13 connected to a frame (not shown) of shell-shaped seat 2 and a second end 14 connected to that frame as suggested on FIG. 3. Being FLEXIBLE-BUT-NON-ELASTIC means that the strap 12 can be bent easily but that the total length of strap 12 does not change when a pulling force is applied on it by a caregiver to lift the shell-shaped seat 2. Handle 11 also comprises an elastic element 15 as suggested in FIG. 3A in the form of an elastic band connected with a first side end 16 to first end 13 of non-elastic strap 12 and with a second side end 17 to non-elastic strap 12 at a first distance from the first end 13 of non-elastic strap 12. The length of elastic element 15 depends on the force applied between the two side ends 16, 17. The carrying part 3, 4 is located on non-elastic strap 12 at a second distance from first end 13 of non-elastic strap 12 that is larger than the first distance. The carrying part 3, 4 is located between second side end 17 of elastic element 15 and second end 14 of non-elastic strap 12.

If no external force is applied by a caregiver on non-elastic strap 12, handle 11 will be in the normal RETRACTED position as shown in FIG. 3A. In the normal RETRACTED position, the length of elastic element 15 is shorter than the length of the part 18 of non-elastic strap 12 that is located between first end 16 and side end 17 of elastic element 15. Part 18 of non-elastic strap 12 is folded due to spring force of elastic element 15.

When an external pulling force F is applied on the carrying part 3, 4 by a caregiver, second side end 17 of elastic element 15 together with part 18 of non-elastic strap 12 connected thereto will be moved toward the passage 7 formed in shell-shaped seat 2 against a spring force of elastic element 15 until part 18 of non-elastic strap 12 is pulled tight and prevents further movement of the second side end 17 of elastic element 15 toward the passage 7. As soon as part 18 of non-elastic strap 12 is pulled tight, the external pulling force F applied on the carrying part 3, 4 by a caregiver will be carried by non-elastic strap 12. The force applied to elastic element 15 is limited to the force needed to extend elastic element 15 to the same length as part 18 of non-elastic strap 12.

In the FIRST embodiment as shown in FIGS. 3A, 3B, the second end 14 of non-elastic strap 12 is connected to a frame (not shown) of shell-shaped seat 2. However, it is also possible to use the second end 14 as carrying part 3, 4, in a manner similar as disclosed in EP1591306A2.

A FIRST embodiment of the carrying device according to the present disclosure is illustrated in FIGS. 3A, 3B and characterized in that the FLEXIBLE-BUT-NON-ELASTIC strap 12 is connected with the at least one end to shell-shaped seat (i.e. seating bucket) 2 while the elastic element 15 is connected with at least one side end to the non-elastic strap 12 at a first distance from the at least one end of the non-elastic strap 12. Handle 11 further comprises at least one carrying part 3 or 4 adapted to be held by the caregiver and located on the non-elastic strap 12 at a second distance from the at least one end of the non-elastic strap 12 that is larger than the first distance. Handle 11 is movable between the normal RETRACTED position and the temporary CARRYING position, whereby in the normal RETRACTED position the non-elastic strap 12 is at least partly folded between the at least one end of the non-elastic strap 12 and the at least one side end of the elastic element 15 due to spring force of elastic element 15, while in the temporary CARRYING position, the non-elastic strap 12 is at least pulled tight between the at least one end of the non-elastic strap 12 and the at least one side end of the elastic element 15 against spring force of elastic element 15.

When seating bucket 2 needs to be lifted, a caregiver takes the carrying part 3 or 4 due to which the weight of the object (e.g. shell-shaped seat 2 and seated infant 8) applies a force on the non-elastic strap 12. Due to this force, the non-elastic strap 12 will be moved from its folded or rippled position into a tight position against the spring force of the elastic element 15 whereby the elastic element 15 will be extended.

A SECOND embodiment of a handle 21 of a carrying device such as a child-carrying device 1 according to the present disclosure is shown in a normal RETRACTED position in FIG. 4A and in a temporary CARRYING position in FIG. 4B. Handle 21 comprises an elongated FLEXIBLE-BUT-NON-ELASTIC strap 22 including a first end 23 and a second end 24 that are each connected to a frame (not shown) of shell-shaped seat (i.e., seating bucket) 2. The first end 23 and a second end 24 are located close to each other as shown in FIGS. 4A and 4B so that non-elastic strap 22 almost forms an endless strap. Handle 21 also comprises an elastic element 25 in the form of an elastic band including a first side end 26 connected to non-elastic strap 22 at a first distance from first end 23 of non-elastic strap 12 and a second side end 27 connected to non-elastic strap 22 at a second distance from second end 24 of non-elastic strap 22 as shown in FIGS. 4A and 4B. The length of elastic element 25 depends on the force applied by a caregiver between the side ends 26, 27. The first carrying part 3 is located on non-elastic strap 22 between first end 23 of non-elastic strap 22 and first side end 26 of elastic element 25, while the second carrying part 4 of handle 21 is located on non-elastic strap 22 between second end 24 of non-elastic strap 22 and second side end 27 of elastic element 25.

If no external force is applied on the non-elastic strap 22, handle 21 will be in the normal RETRACTED position as shown in FIG. 4A. In such a normal RETRACTED position the length of elastic element 25 is shorter than the length of part 28 of non-elastic strap 22 located between first and second ends 26 of elastic element 25. Part 28 of non-elastic strap 22 is folded as suggested in FIG. 4A due to spring force of elastic element 25.

When an external pulling force F is applied by a caregiver on the carrying part 3, 4 as suggested in FIG. 4B, both the first and second sides ends 26, 27 of elastic element 25 together with part 28 of non-elastic strap 22 connected thereto will be moved toward the passage 7 formed in shell-shaped seat 2 (See FIGS. 1 and 2) against the spring force of elastic element 25 until part 28 of non-elastic strap 22 is pulled tight and prevents further movement of first and second side ends 26, 27 of elastic element 25 toward the passage 7. As soon as part 28 of non-elastic strap 22 is pulled tight, the external pulling forces F applied on the carrying parts 3, 4 by the caregiver will be carried by non-elastic strap 22. The force applied to elastic element 25 is limited to the force needed to extend elastic element 25 to the same length as part 28 of non-elastic strap 22.

A SECOND embodiment of the carrying device according to the present disclosure is illustrated in FIGS. 4A and 4B and characterized in that the non-elastic strap 22 is connected with both ends 23, 24 to the seating bucket 2, while the elastic element 25 is connected at both side ends 26, 27 to the non-elastic strap 22 at distances from the both ends 23, 24 of the non-elastic strap 22 as suggested in FIG. 4A. In the normal RETRACTED position, the both side ends 26, 27 are located closer to each other than in the temporary CARRYING position, while the non-elastic strap 22 is at least partly folded between the both side ends 26, 27 of the elastic band 25 as suggested in FIG. 4A.

When a part of the non-elastic strap 22 near a first 23 of the both ends 23, 24 is used as a carrying part to lift the seating bucket 2, a part of the non-elastic strap 22 between the carrying part and the second 24 of the both ends 23, 24 will be pulled tight between the second end 24 of the non-elastic strap 22 and the side end of the elastic element 25 located close to the carrying part against spring force of the elastic band 25. When a part of the non-elastic strap 22 near the second 24 of the both ends 23, 24 is used as a carrying part to lift the seating bucket 2, a part of the non-elastic strap 22 between the carrying part and the first 23 of the both ends 23, 24 will be pulled tight between the first end 23 of non-elastic strap 22 and the side end of the elastic element 25 located close to the carrying part against spring force of the elastic band 25.

It is also possible to use both parts of the non-elastic strap 22 near the first and second ends 23, 24 as carrying parts 3, 4 to lift the seating bucket 2 by means of two carrying parts 23, 24. This provides a more stable position of the seating bucket 2 with respect to the handle 21 being less prone to swinging of the seating bucket 2 with respect to the handle 21.

A THIRD embodiment of a handle 31 of a child-carrying device according to the present disclosure is shown in FIGS. 5A-D.

Figure 5A:
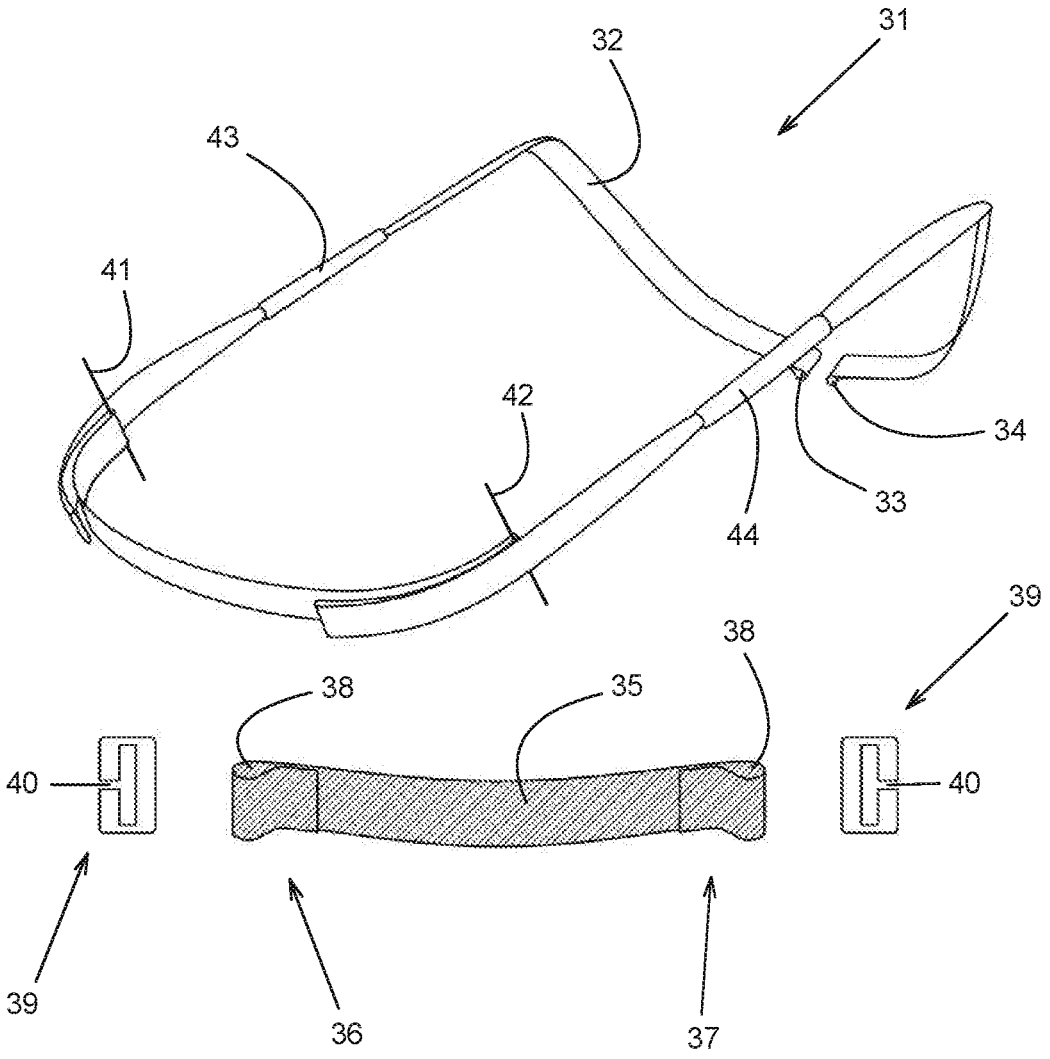
FIGS. 5A and 5B are an exploded view and perspective view of a third embodiment of a handle of a carrying device according to the present disclosure showing each of the carrying parts of the handle in a normal RETRACTED position.

FIG. 5A shows an exploded perspective assembly view of handle 31. Handle 31 comprises an elongated FLEXIBLE-BUT-NON-ELASTIC strap 32 having a first end 33 connected to a frame (not shown) of shell-shaped seat 2 and a second end 34 also connected to that frame. First end 33 and second end 34 are located close to each other as suggested in FIG. 5A so that non-elastic strap 32 almost forms an endless strap. Handle 31 also comprises an elastic element 35 in the form of an elastic band provided with a first side end 36 and a second side end 37. The side ends 36, 37 comprise closed loops 38 as shown in FIG. 5A. The length of elastic element 35 depends on the force applied by a caregiver between the two side ends 36, 37. The loops 38 of the two side ends 36, 37 of elastic element 35 are each connected to a C-shaped bracket 39 as suggested in FIG. 5B. C-shaped bracket 39 is almost ring-shaped as shown in FIG. 5A and comprises a slit 40 to be able to connect C-shaped bracket 39 to loops 38 in a manner shown in FIG. 5B.

Seen from the first end 33 as suggested in FIG. 5A, non-elastic strap 32 is guided through C-shaped bracket 39 connected to first side end 36 of elastic element 35, around a first pin-shaped element 41 connected to the frame (not shown) of shell-shaped seat 2, around a second pin-shaped element 42 connected to the frame (not shown) of shell-shaped seat 2, through the C-shaped bracket 39 connected to second side end 37 of elastic element 35 and to the second end 34. The first and second pin-shaped elements 41, 42 form first pulley-shaped elements, while the C-shaped brackets 39 form second pulley-shaped elements in accordance with the present disclosure.

The non-elastic strap 32 comprises a first carrying part 43 located on non-elastic strap 32 between first end 33 of non-elastic strap 32 and first side end 36 of elastic element 35 and a second carrying part 44 located on non-elastic strap 32 between second end 34 of non-elastic strap 32 and second side end 37 of elastic element 35 as suggested in FIG. 5A. The first and second carrying parts 43, 44 comprise a gripping element being thicker than the non-elastic strap 32 to enhance the comfort for a person, when lifting the carrying device 1.

Figure 5B:
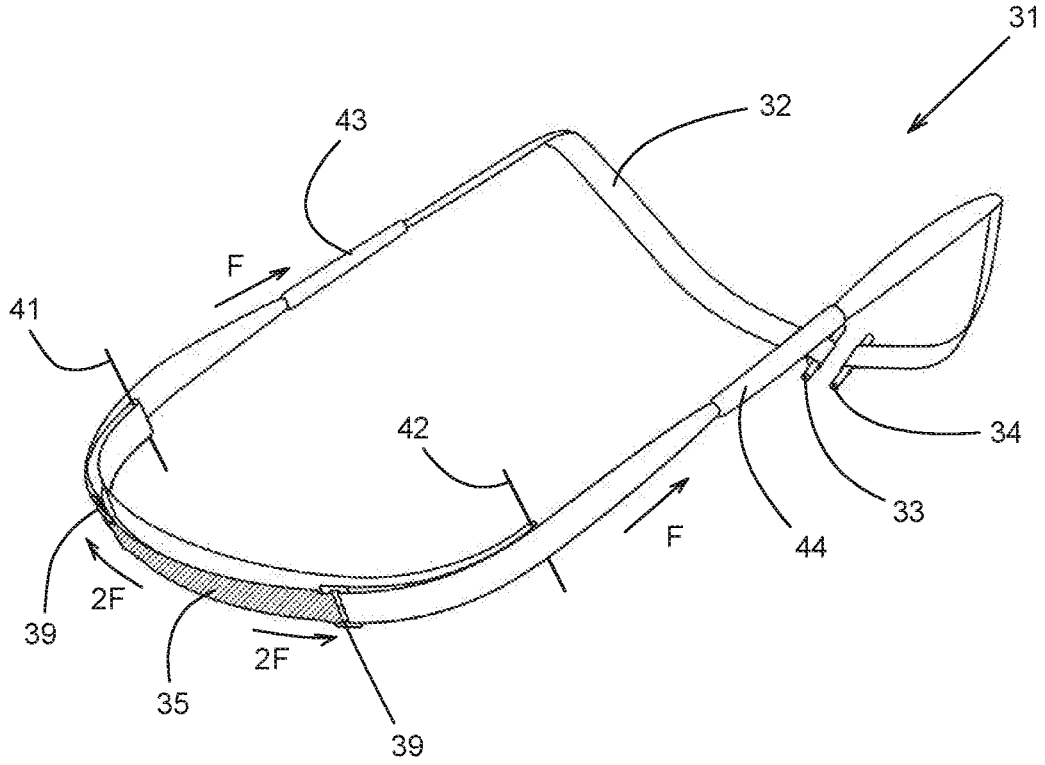

Handle 31 is shown in FIG. 5B in the normal RETRACTED position. When a person takes hold of the carrying parts 43, 44 of handle 31, a force F is applied on non-elastic strap 32. Due to the pulley-shaped elements, this results in application of a force of 2F on the side ends 36, 37 of elastic element 35. When each side ends 36, 37 of elastic element 35 is displaced over a certain distance D toward the nearest pin-shaped elements 41, 42, the carrying parts 43, 44 of handle 31 will displaced over twice said distance D, so over a distance 2D. So the person lifting the carrying device 1, needs half the force compared with the embodiment as shown in FIGS. 4A and 4B to obtain the same displacement of the carrying parts 43, 44 of handle 31. To the person, the retracting of non-elastic strap 32 is being done with half the force and therefore feels less aggressive when the carrying parts 43, 44 are released.

Figure 5C:
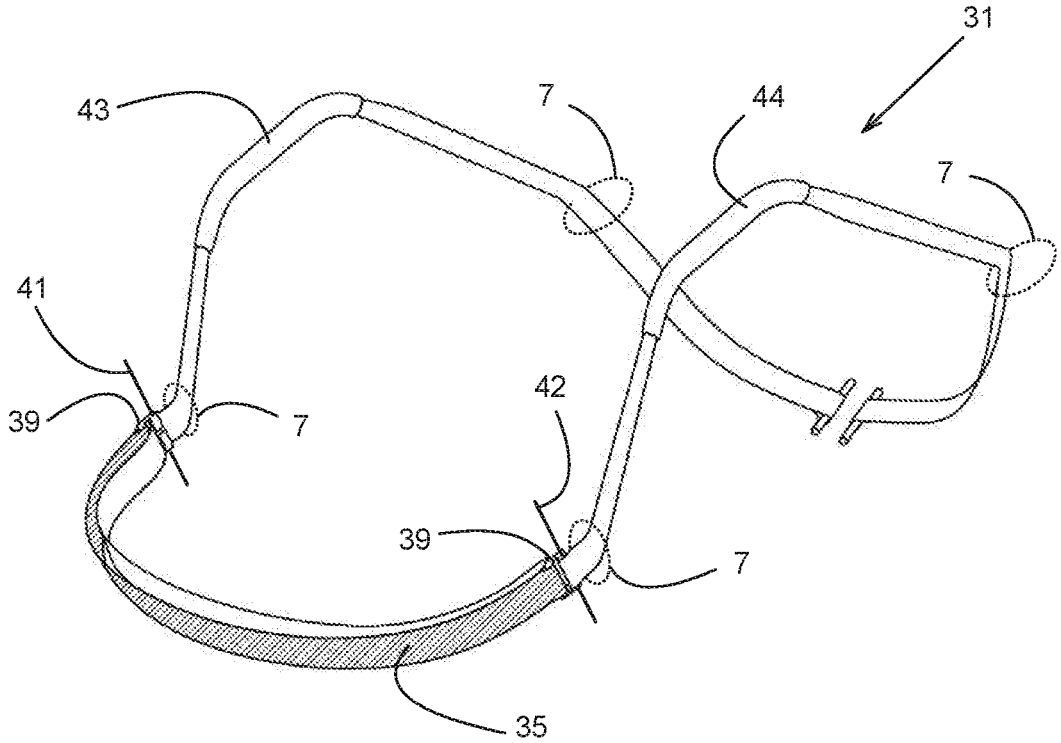
FIG. 5C is a perspective view of the third embodiment of a handle of a carrying device according to the present disclosure showing each of the carrying parts of the handle in a temporary CARRYING position.
Figure 5D:
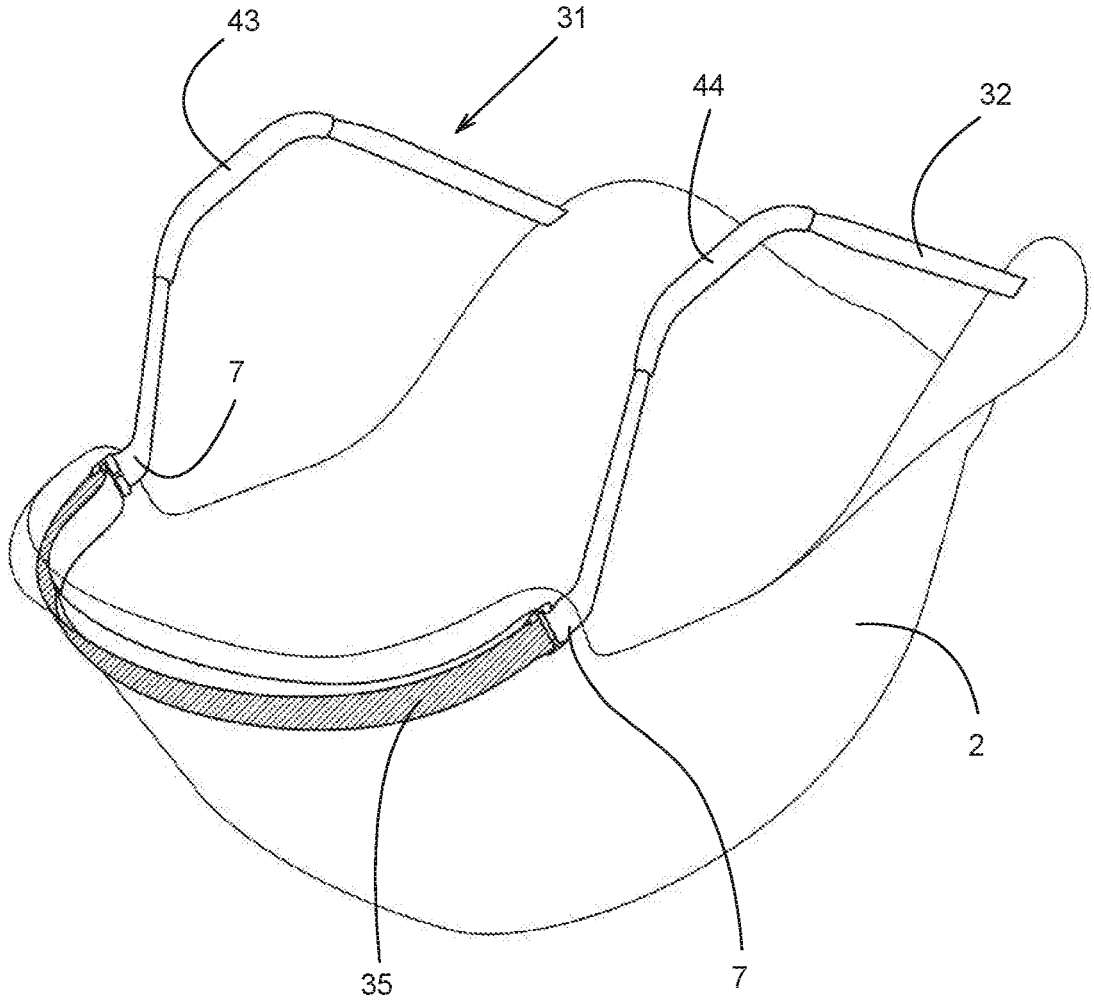
FIG. 5D is a perspective view of the third embodiment of a handle of a carrying device according to the present disclosure on a child-carrying device showing each of the carrying parts of the handle in a temporary CARRYING position.

The side ends 36, 37 of elastic element 35 will be displaced towards the nearest pin-shaped elements 41, 42 until non-elastic strap 32 is pulled tight and cannot be further moved out of the passage 7 formed in shell-shaped seat 2 and is in the temporary CARRYING position as shown in FIGS. 5C and 5D. As can be seen in FIG. 5D, non-elastic strap 32 extends around the circumference of shell-shaped seat 2. Therefore, the lifting forces will be distributed over the whole circumference of shell-shaped seat 2. It is also possible within the scope of the present disclosure to cut the non-elastic strap 32 and the elastic element 35 near the middle of the elastic element 35 into two similar halves and to connect the separated ends directly to the frame of shell-shaped seat 2.

A THIRD embodiment of the carrying device according to the present disclosure is characterized in that the handle 31 comprises two carrying parts 43, 44 located on each side of the elastic element 35 on the non-elastic strap 32 as suggested n FIGS. 5A-5D. By using two carrying parts, a more stable position of the seating bucket 2 is provided with respect to the handle 31 being less prone to swinging of the seating bucket 2 with respect to the handle 31.

A FOURTH embodiment of a child-carrying device 50 according to the present disclosure is shown in a normal RETRACTED position in FIG. 6A and in a temporary CARRYING position in FIG. 6B. The child-carrying device 50 comprises a shell-shaped seat 51 and a handle 52. Shell-shaped seat 51 comprises at least a passage 7 and first pulley-shaped element 53. Handle 52 comprises a FLEXIBLE-BUT-NON-ELASTIC strap 54 connected with a first end 55 to shell-shaped seat 51 and provided at a second end 56 with a carrying part. Handle 52 also comprises an elastic element 57 provided with at least at one end with a second pulley-shaped element 58. The other end of elastic element 57 can be connected to shell-shaped seat 51 or also be provided with a second pulley-shaped element 58 in a manner similar to the THIRD embodiment.

When a force F is applied by a caregiver on second end 56 of non-elastic strap 54, second pulley-shaped element 58 will be pulled in the direction of first pulley-shaped element 53 over a certain distance D against the spring force of elastic element 57. Due to the movement of second pulley-shaped element 58, second end 56 of non-elastic strap 54 will be moved over twice this distance D and the force applied on elastic element 57 will be twice the force F.

The second end 56 can be moved into the direction of the force F until non-elastic strap 54 is pulled tight. As soon as the force F is removed, non-elastic strap 54 will be pulled back from the temporary CARRYING position as shown in FIG. 6B to the normal RETRACTED position as shown in FIG. 6A due to the spring force of elastic element 57.

A FOURTH embodiment of the carrying device according to the present disclosure is characterized in that the two carrying parts can be positioned AGAINST each other in the temporary CARRYING position. AGAINST in the context of the present disclosure means that the two carrying parts abut each other or are so close to each other that a caregiver can hold both carrying parts of the handle 52 in one hand.

A FIFTH embodiment of a child-carrying device 60 according to the present disclosure is shown in a normal RETRACTED position in FIG. 7A and in a temporary CARRYING position in FIG. 7B. FIFTH embodiment differs only from the FOURTH embodiment in that the first pulley-shaped element 61 is formed by two slits 62, 63 in a wall 64 of shell-shaped seat 51.

A FIFTH embodiment of the carrying device according to the present disclosure is characterized in that the non-elastic strap 54 is guided along at least a first pulley-shaped element connected to the seating bucket 2 and through at least a second pulley-shaped element connected to the at least one side end of the elastic band 57. The second pulley-shaped element is movable against spring force of the elastic element 57 towards the at least a first pulley-shaped element to reduce the distance therebetween.

Both pulley-shaped elements act as pulleys. This has the advantage that if the second pulley-shaped element moves under a certain force over a certain distance towards the first pulley-shaped element that an end of the non-elastic strap 54 guided along the first and second pulley-shaped elements will be moved over twice said distance at half said force.

A SIXTH embodiment of the carrying device according to the present disclosure is characterized in that the elastic element is located inside the seating bucket 2, while the non-elastic strap extends through at least one passage formed in the seating bucket 2 from the inside to the outside of the seating bucket 2. By locating the elastic element inside the seating bucket 2, the elastic element is hidden from view and a caregiver will only see the non-elastic strap. When pulling on the non-elastic strap, the caregiver will only experience that the non-elastic strap will get longer. In the CARRYING position, the caregiver will not notice the spring force and will have a safety perception identical to the caregiver experience with non-elastic straps without such an elastic band.

A SEVENTH embodiment of the carrying device according to the present disclosure is characterized in that the carrying device is a child-carrying device like a child seat, a child vehicle seat, and a carry cot. The carrying device is very suitable for a child-carrying device whereby a caregiver must be able to pick up the child-carrying device easily, preferably holding two carrying parts in one hand, having a good safety perception. Since the weight of the child-carrying device is being carried by the non-elastic strap, the risk that such strap will break is minimized. Furthermore, overstretching of the elastic element is also minimized as discussed herein, so that the retracting function will stay working and have a long lifespan.

An EIGHTH embodiment of the carrying device according to the present disclosure is characterized in that the non-elastic strap is located on two lateral sides of the child-carrying device in the normal RETRACTED position of the non-elastic strap. This provides the non-elastic strap in reach of a person who wants to carry the child-carrying device, while not being in front of the child in the normal RETRACTED position FIGS. 8-10 show perspective views of a child-carrying device 71, 81, 91 with different locations and orientations of the handle 72, 82, 92 according to the present disclosure. Each child-carrying device 71, 81, 91 comprises a shell-shaped seat 2 with a first and second lateral side 5, 6 and a handle 72, 82, 92 with two carrying parts 3, 4 located near the first and second lateral side 5, 6 respectively.

Handle 72 of child-carrying device 71 comprises an endless or nearly endless non-elastic strap 73 provided with two parts 74, 75 each extending from a first lateral side 5 to a second lateral side 6 over a bottom 76 of shell-shaped seat 2 as shown in FIG. 8. Handle 72 also comprises an elastic element according to one of the other disclosed embodiments.

Handle 82 of child-carrying device 81 comprises a non-elastic strap 83 connected with ends 84 to the lateral sides 5, 6 and with one part extending from a first lateral side 5 to a second lateral side 6 over a bottom 76 of shell-shaped seat 2 as shown in FIG. 9. Handle 82 also comprises an elastic element according to one of the other disclosed embodiments.

Handle 92 of child-carrying device 91 comprises an endless or nearly endless non-elastic strap 93 provided with two parts 94 each extending from a first lateral side 5 to a second lateral side 6 along respectively an upper part 95 and lower part 96 of shell-shaped seat 2 as shown in FIG. 10. The handle 92 also comprises an elastic element according to one of the other disclosed embodiments.

The shell-shaped seats made in accordance with the present disclosure preferably comprise elements configured and arranged to hide the elastic element and the pulley-shaped elements, if present, from view. It is also possible in accordance with the present disclosure to provide an elastic element on each side of the carrying parts. It is also possible in accordance with the present disclosure to use only one carrying part. It is also possible in accordance with the present disclosure to use the handle on a child vehicle seat or a carry cot. However it can also be a suitcase or bag or other object to be carried. Instead of a C-shaped bracket, it is also possible to use other shaped connection elements.

Carrying device (1, 50, 60, 71, 81, 91) comprises at least one OBJECT to be carried and at least one handle (11, 21, 31, 52, 72, 82, 92) connected with at least one end (13, 14, 23, 24, 33, 34, 55, 56, 84) to the OBJECT. The carrying device is characterized in that the handle (11, 21, 31, 52, 72, 82, 92) is movable between a RETRACTED position and a CARRYING position. Retractable handle (11, 21, 31, 52, 72, 82, 92) comprises a FLEXIBLE-BUT-NON-ELASTIC strap (12, 22, 32, 54, 73, 83) adapted to be held by a caregiver and at least one elastic element (15, 25, 35, 57) coupled to the FLEXIBLE-BUT-NON-ELASTIC strap (12, 22, 32, 54, 73, 83) and configured to bias the FLEXIBLE-BUT-NON-ELASTIC strap (12, 22, 32, 54, 73, 83) toward the RETRACTED position.

Carrying device (1, 50, 60, 71, 81, 91) is further characterized in that the flexible, non-elastic strap (12, 22, 32, 54, 73, 83) is connected with the at least one end (13, 14, 23, 24, 33, 34, 55, 56, 84) to the OBJECT, while the elastic element (15, 25, 35, 57) is connected with at least one side end (16, 17, 26, 27, 36, 37) to the FLEXIBLE-BUT-NON-ELASTIC strap (12, 22, 32, 54, 73, 83) at a first distance from the at least one end (13, 14, 23, 24, 33, 34, 55, 56, 84) of the FLEXIBLE-BUT-NON-ELASTIC strap (12, 22, 32, 54, 73, 83). Handle (11, 21, 31, 52, 72, 82, 92) further comprises at least one carrying part (3, 4, 43, 44) adapted to be held by the caregiver and located on the FLEXIBLE-BUT-NON-ELASTIC strap (12, 22, 32, 54, 73, 83) at a second distance from the at least one end of the FLEXIBLE-BUT-NON-ELASTIC strap (12, 22, 32, 54, 73, 83) that is larger than the first distance. Handle (11, 21, 31, 52, 72, 82, 92) is movable between the RETRACTED position and the CARRYING position, whereby in the RETRACTED position the FLEXIBLE-BUT-NON-ELASTIC strap (12, 22, 32, 54, 73, 83) is at least partly folded between the at least one end (13, 14, 23, 24, 33, 34, 55, 56, 84) of the FLEXIBLE-BUT-NON-ELASTIC strap (12, 22, 32, 54, 73, 83) and the at least one end side (16, 17, 26, 27, 36, 37) of the elastic element (15, 25, 35, 57) due to spring force of the elastic element (15, 25, 35, 57), while in the CARRYING position, the FLEXIBLE-BUT-NON-ELASTIC strap (12, 22, 32, 54, 73, 83) is at least pulled tight between the at least one end (13, 14, 23, 24, 33, 34, 55, 56, 84) of the FLEXIBLE-BUT-NON-ELASTIC strap (12, 22, 32, 54, 73, 83) and the at least one side end (16, 17, 26, 27, 36, 37) of the elastic element (15, 25, 35, 57) against spring force of the elastic element (15, 25, 35, 57).

Carrying device (1, 50, 60, 71, 81, 91) is further characterized in that the non-elastic strap (12, 22, 32, 54, 73, 83) is connected with both ends (13, 14, 23, 24, 33, 34, 55, 56, 84) to the object, while the elastic element (15, 25, 35, 57) is connected at both side ends (16, 17, 26, 27, 36, 37) to the FLEXIBLE-BUT-NON-ELASTIC strap (12, 22, 32, 54, 73, 83) at distances from the both ends (13, 14, 23, 24, 33, 34, 55, 56, 84) of the FLEXIBLE-BUT-NON-ELASTIC strap (12, 22, 32, 54, 73, 83), In the RETRACTED position the both side ends (16, 17, 26, 27, 36, 37) are located closer to each other than in the CARRYING position, while the FLEXIBLE-BUT-NON-ELASTIC strap (12, 22, 32, 54, 73, 83) is at least partly folded between the both side ends (16, 17, 26, 27, 36, 37) of the elastic element (15, 25, 35, 57).

Carrying device (1, 50, 60, 71, 81, 91) is further characterized in that the handle (11, 21, 31, 52, 72, 82, 92) comprises two carrying parts (3, 4) located on each side of the elastic element (15, 25, 35, 57) on the FLEXIBLE-BUT-NON-ELASTIC strap (12, 22, 32, 54, 73, 83).

Carrying device (1, 50, 60, 71, 81, 91) is further characterized in that the two carrying parts (3, 4) can be positioned against each other in the CARRYING position.

Carrying device (1, 50, 60, 71, 81, 91) further characterized in that the FLEXIBLE-BUT-NON-ELASTIC strap (12, 22, 32, 54, 73, 83) is guided along at least a first pulley-shaped element (53, 61) connected to the object and through at least a second pulley-shaped element (58) connected to the at least one side end of the elastic element (15, 25, 35, 57), whereby the second pulley-shaped element (58) is movable against spring force of the elastic element (15, 25, 35, 57) towards the at least a first pulley-shaped element (53, 61) to reduce the distance therebetween.

Carrying device (1, 50, 60, 71, 81, 91) is further characterized in that the elastic element (15, 25, 35, 57) is located inside the object, while the FLEXIBLE-BUT-NON-ELASTIC strap (12, 22, 32, 54, 73, 83) extends through at least one passage (7) in the object from the inside to the outside of the OBJECT.

Carrying device (1, 50, 60, 71, 81, 91) is further characterized in that the carrying device (1, 50, 60, 71, 81, 91) is a child-carrying device (1, 50, 60, 71, 81, 91) like a child seat, a child vehicle seat, or a carry cot.

Carrying device (1, 50, 60, 71, 81, 91) is further characterized in that the non-elastic strap (12, 22, 32, 54, 73, 83) is located on two lateral sides of the child-carrying device (1, 50, 60, 71, 81, 91) in the RETRACTED position of the FLEXIBLE-BUT-NON-ELASTIC strap (12, 22, 32, 54, 73, 83).

The invention claimed is:

1. A carrying device comprising at least one object to be carried and at least one handle connected with at least one end to the object, wherein the handle is movable between a retracted position and a carrying position, the retractable handle comprises a flexible, non-elastic strap and at least one elastic element coupled to the flexible, non-elastic strap and configured to bias the flexible, non-elastic strap toward the retracted position, wherein the flexible, non-elastic strap is connected with the at least one end to the object, while the elastic element is connected with at least one side end to the non-elastic strap at a first distance from the at least one end of the non-elastic strap, which handle further comprises at least one carrying part adapted to be held by the caregiver and located on the non-elastic strap at a second distance from the at least one end of the non-elastic strap being larger than the first distance, wherein the handle is movable between the retracted position and the carrying position, whereby in the retracted position the non-elastic strap is at least partly folded between the at least one end of the non-elastic strap and the at least one side end of the elastic element due to spring force of the elastic element, while in the carrying position, the non-elastic strap is at least pulled tight between the at least one end of the non-elastic strap and the at least one side end of the elastic element against spring force of the elastic element.

2. The carrying device of claim 1, wherein the non-elastic strap is connected with both ends to the object, while the elastic element is connected at both side ends to the non-elastic strap at distances from the both ends of the non-elastic strap, wherein in the retracted position the both side ends are located closer to each other than in the carrying position, while the non-elastic strap is at least partly folded between the both side ends of the elastic element.

3. The carrying device of claim 2, wherein the handle comprises two carrying parts located on each side of the elastic element on the non-elastic strap.

4. The carrying device of claim 3, wherein the two carrying parts can be positioned against each other in the carrying position.

5. The carrying device of claim 1, wherein the non-elastic strap is guided along at least a first pulley-shaped element connected to the object and through at least a second pulley-shaped element connected to the at least one side end of the elastic element, whereby the second pulley-shaped element is movable against spring force of the elastic element towards the at least a first pulley-shaped element to reduce the distance therebetween.

6. The carrying device of claim 1, wherein the carrying device is a child-carrying device like a child seat, a child vehicle seat, or a carry cot.

7. The carrying device of claim 6, wherein the non-elastic strap is located on two lateral sides of the child-carrying device in the retracted position of the non-elastic strap.

8. A carrying device comprising at least one object to be carried and at least one handle connected with at least one end to the object, wherein the handle is movable between a retracted position and a carrying position, the retractable handle comprises a flexible, non-elastic strap and at least one elastic element coupled to the flexible, non-elastic strap and configured to bias the flexible, non-elastic strap toward the retracted position, wherein the elastic element is located at least partially inside the object, while the non-elastic strap extends through at least one passage formed in the object from the inside to the outside of the object.

9. The carrying device of claim 8, wherein the elastic element of each of the first and second side carrying parts remains hidden from view of the caregiver when the movable strap occupies the normal retracted position and the temporary carrying position.

10. The carrying device of claim 9, wherein the object is a seating bucket for an infant and the object carrier is a bucket carrier.

11. The carrying device of claim 8, wherein the flexible, non-elastic strap is connected with the at least one end to the object, while the elastic element is connected with at least one side end to the non-elastic strap at a first distance from the at least one end of the non-elastic strap, which handle further comprises at least one carrying part adapted to be held by the caregiver and located on the non-elastic strap at a second distance from the at least one end of the non-elastic strap being larger than the first distance, wherein the handle is movable between the retracted position and the carrying position, whereby in the retracted position the non-elastic strap is at least partly folded between the at least one end of the non-elastic strap and the at least one side end of the elastic element due to spring force of the elastic element, while in the carrying position, the non-elastic strap is at least pulled tight between the at least one end of the non-elastic strap and the at least one side end of the elastic element against spring force of the elastic element.

12. Carrying A carrying device comprising an object to be carried and an object carrier coupled to the object, the object carrier including first and second side carrying parts, wherein each side carrying part includes a movable strap and an elastic element, the movable strap is arranged to be gripped by a caregiver to allow the caregiver to carry the object, the elastic element is coupled to the movable strap and to the object, the elastic element is configured to yieldably and automatically pull the movable strap in an inward direction through a strap-receiving passage formed in the object from a temporary carrying position to a normal retracted position when the movable strap is released by a caregiver that had been using the handle to carry the object, the elastic element is configured to allow the movable strap to be moved through the strap-receiving passage formed in the object in an opposite outward direction to move from the normal retracted position to the temporary carrying position in response to application of an external pulling force on the movable strap by the caregiver.

13. The carrying device of claim 12, wherein the elastic element of each of the first and second side carrying parts remains hidden from view of the caregiver in a covered space when the movable strap occupies the normal retracted position or the temporary carrying position.

14. The carrying device of claim 12, wherein the object is a seating bucket for an infant and the object carrier is a bucket carrier.

15. The carrying device of claim 14, wherein the flexible, non-elastic strap is connected with at least one end to the seating bucket, while the elastic element is connected with at least one side end to the non-elastic strap at a first distance from the at least one end of the non-elastic strap, wherein the of the first and second side carrying parts includes a handle adapted to be held by the caregiver and located on the non-elastic strap at a second distance from the at least one end of the non-elastic strap, the second distance being larger than the first distance.

16. The carrying device of claim 15, wherein in the retracted position the non-elastic strap is at least partly folded between the at least one end of the non-elastic strap and the at least one side end of the elastic element due to spring force of the elastic element, and wherein in the carrying position, the non-elastic strap is pulled tight between the at least one end of the non-elastic strap and the at least one side end of the elastic element against spring force of the elastic element.

17. The carrying device of claim 12, wherein the non-elastic strap is connected with both ends to the object, and the elastic element is connected at both side ends to the non-elastic strap at distances from the both ends of the non-elastic strap, wherein in the retracted position the both side ends are located closer to the other than in the carrying position, while the non-elastic strap is at least partly folded between the both side ends of the elastic element.

18. The carrying device of claim 12, wherein the non-elastic strap is guided along at least a first pulley-shaped element and connected to the object and through at least a second pulley-shaped element connected to the at least one side end of the elastic element, whereby the second pulley-shaped element is movable against spring force of the elastic element towards the at least a first pulley-shaped element to reduce the distance therebetween.

19. The carrying device of claim 18, wherein the two carrying parts can be positioned against the other above the seating bucket in the carrying position.

20. The carrying device of claim 12, wherein the strap-receiving passage in an upper rim of the object and the elastic element is located at least partially below the upper rim.

* * * * *